US010265598B1

(12) United States Patent
Gagne

(10) Patent No.: US 10,265,598 B1
(45) Date of Patent: Apr. 23, 2019

(54) FOOTBALL SNAPPER

(71) Applicant: Adam Gagne, Westford, MA (US)

(72) Inventor: Adam Gagne, Westford, MA (US)

( * ) Notice: Subject to any disclaimer, the term of this patent is extended or adjusted under 35 U.S.C. 154(b) by 0 days.

(21) Appl. No.: 15/984,556

(22) Filed: May 21, 2018

Related U.S. Application Data

(60) Provisional application No. 62/510,295, filed on May 24, 2017.

(51) Int. Cl.

| | |
|---|---|
| ***F41B 3/02*** | (2006.01) |
| ***A63B 69/40*** | (2006.01) |
| ***A63B 47/00*** | (2006.01) |

(52) U.S. Cl.
CPC ..... *A63B 69/407* (2013.01); *A63B 47/001* (2013.01); *F41B 3/02* (2013.01); *A63B 2069/402* (2013.01); *A63B 2243/007* (2013.01)

(58) Field of Classification Search
CPC ..... A63B 69/407; F41B 3/02
See application file for complete search history.

(56) References Cited

U.S. PATENT DOCUMENTS

| | | | |
|---|---|---|---|
| 3,399,892 | A | 9/1968 | Jurkiewicz |
| 3,700,238 | A | 10/1972 | Mathis |
| 3,926,170 | A | 12/1975 | Dixon |
| 3,977,386 | A | 8/1976 | Meyer |
| 4,261,319 | A | 4/1981 | Dixon |
| 4,906,001 | A | 3/1990 | Vaughn |
| 5,447,144 | A | 9/1995 | Ivy |
| 5,813,391 | A | 9/1998 | Johnson |
| 6,050,906 | A | 4/2000 | Stout et al. |
| D476,385 | S | 6/2003 | Curry |
| 6,575,852 | B2 | 6/2003 | Orner |
| 6,718,961 | B1 | 4/2004 | Woods et al. |
| 7,125,349 | B2 | 10/2006 | Tucker |
| 7,905,222 | B1 | 3/2011 | Fenley |
| D656,208 | S | 3/2012 | Warner |
| 8,460,130 | B1 | 6/2013 | Earle |
| 8,932,156 | B2 | 1/2015 | Boehner |
| 9,022,016 | B1 | 5/2015 | Hafer et al. |
| 2006/0035733 | A1 | 2/2006 | Silver et al. |

FOREIGN PATENT DOCUMENTS

| | | | |
|---|---|---|---|
| GB | 2007984 | A | 5/1979 |

*Primary Examiner* — John Ricci
(74) *Attorney, Agent, or Firm* — Clocktower Law; Erik J. Heels; Michael A. Bartley

(57) ABSTRACT

A portable automatic football snapper may be built as a tube to launch football snaps while being lightweight and able to be carried by handle, shoulder-strap, or clipped onto another backpack. The snapper is small and can store a football within, and, when stood upright, may serve as a stand for a football placed on top to simulate an "under center" exchange. A stand built into a side of the bag extends to establish a base and ideal snap angle for shotgun snap use. Inside the snapper, a cup may be used to hold the football, may be pulled down and clipped into a pre-snap position, and upon release is pulled upwards, launching or "snapping" the ball in a spiral to the quarterback. The release may be manual, automatic based on a mechanical or electronic timer, or sound-activated or remote controlled allowing snap control by the quarterback.

18 Claims, 8 Drawing Sheets

FOOTBALL SNAPPER

CROSS-REFERENCE TO RELATED APPLICATIONS

This utility patent application claims priority from U.S. provisional patent application Ser. No. 62/510,295, filed May 24, 2017, titled "Football Snapper" and naming inventor Adam Gagne.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Field of Technology

This relates to football, and more specifically to devices for football storage and training.

Background

Football is a team game, but parts are often practiced individually or in small groups. There are no options for quarterbacks to practice "shotgun" snaps by themselves. Shotgun snapping a football requires more than one person—a "snapper" the quarterback (snap "catcher"). Often a quarterback or coach does not have access another individual willing to snap. There are some solutions with existing machines to snap or throw a football. These are generally large, making them difficult to maneuver and not practical to port to-and-from playing field, and often require an operator, which does not solve the problem when working individually.

DESCRIPTION OF PRIOR ART

U.S. Pat. No. 7,905,222 ("FOOTBALL THROWING MACHINE", 2015 Mar. 15, inventor Fenley) discloses, in the Abstract, "One embodiment of a football throwing machine using an axially aligned compression spring for propulsion and a latching mechanism for retaining the spring in its compressed state. A spiral shaped actuator mechanism is used to compress the spring with consistent torque throughout the compression stroke. The spring is released from its compressed state using an efficient triggering mechanism. A timing mechanism allows a delay so the user can position for the catch. The football is held by axially misaligned wheels on one end and a rotating cup on the other. As the spring pushes the ball between the wheels while being ejected from the apparatus, the wheel misalignment causes the helical spinning effect on the football while the cup holding the other end of the football spins freely." This device is large and targeted at replicating throwing of footballs for catching practice.

U.S. Pat. No. 5,447,144 ("APPARATUS FOR THROWING FOOTBALLS", 1995 Sep. 5, inventor Ivy) discloses, in the Abstract, "Apparatus for propelling projectiles and particularly suited to throwing footballs. The apparatus includes (a) a structural frame having elongate bearing surfaces and a forward end from which the projectiles are ejected; (b) a ball carriage adapted to contain the projectile, the carriage being slidingly mounted on the bearing surfaces; (c) at least one resilient member for so urging the carriage along the bearing surfaces towards the forward end that the projectile is propelled from the carriage at the forward end of the frame; and (d) a ball rotating assembly mounted on the ball carriage for applying rotation to the projectile as the projectile is propelled from the apparatus. A locking apparatus may also be provided for releasably locking the ball carriage relative to the structural frame. The propelling apparatus, when used in conjunction with a supporting pole, can be accurately aimed and operated by one person." This device is intended to be operated by one person to simulate throws of a specific individual when that individual is not present or unable to throw.

U.S. Pat. No. 8,460,130 ("FOOTBALL SNAP AID", 2013 Jun. 11, inventor Earle) discloses, in the Abstract, "The football snap aid simulates a snap of a football by a center to a quarterback located behind. The football snap aid includes an apparatus that supports a padded release lever from below, and which when engaged in an upward movement shall release a spring-loaded arm that supports a football on a cradle. The spring-loaded arm translates from a lowered position to a hiked position so as to simulate actual movement of the football during a snap. The football snap aid includes an upper handle and locking tab that can rotate to reset the spring-loaded arm between uses. The apparatus includes adjustable legs that can accommodate differently sized end user. The spring-loaded arm includes adjustment means to accommodate differently sized end users." This is targeted at an adjustable device for simulating under-center snaps.

None of the above provides a football snapping device that (1) is easily portable by a single person, (2) includes multiple carrying options, (3) can store a football within, (4) simulates both under-center and shotgun snaps for a quarterback, and (5) can work in single-person operation by a quarterback. What is needed, therefore, is a device that overcomes the above-mentioned limitations and that includes the features enumerated above.

BRIEF SUMMARY

A solution is a portable automatic football snapper built as a tube to launch football snaps while being carry-able as a bag. The snapper is lightweight, able to be carried by handle, shoulder-strap, or clipped onto another backpack. The snapper is small and can store a football within. The snapper is sized such that, when stood upright, it serves as a stand for a football placed on top to simulate an "under center" exchange. A stand built into a side of the bag extends to establish a base and ideal snap angle for shotgun snap use. Inside the snapper, a cup may be used to hold the football, may be pulled down and clipped into a pre-snap position, and upon release is pulled upwards, launching or "snapping" the ball in a spiral to the quarterback. The release may be manual, automatic based on a mechanical or electronic timer, or sound-activated or remote controlled allowing snap control by the quarterback.

This results in a 1-person operable snapper, with easy, single-person storage, portability, and operation. A lone quarterback can carry the snapper (and football within) to practice locations and operate without any center or person snapping involved. Single-person snap-and-throw practice is enabled to practice throws to targets or locations, two-person practice with a receiver (or three with a defender added) is possible to include shotgun simulation and timing without any additional person snapping the football.

BRIEF DESCRIPTION OF THE DRAWINGS

In the drawings, closely related figures and items have the same number but different alphabetic suffixes. Processes, states, statuses, and databases are named for their respective functions.

DETAILED DESCRIPTION, INCLUDING THE PREFERRED EMBODIMENT

In the following detailed description, reference is made to the accompanying drawings which form a part hereof, and in which are shown, by way of illustration, specific embodiments which may be practiced. It is to be understood that other embodiments may be used, and structural changes may be made without departing from the scope of the present disclosure.

Operation

Figure 1:
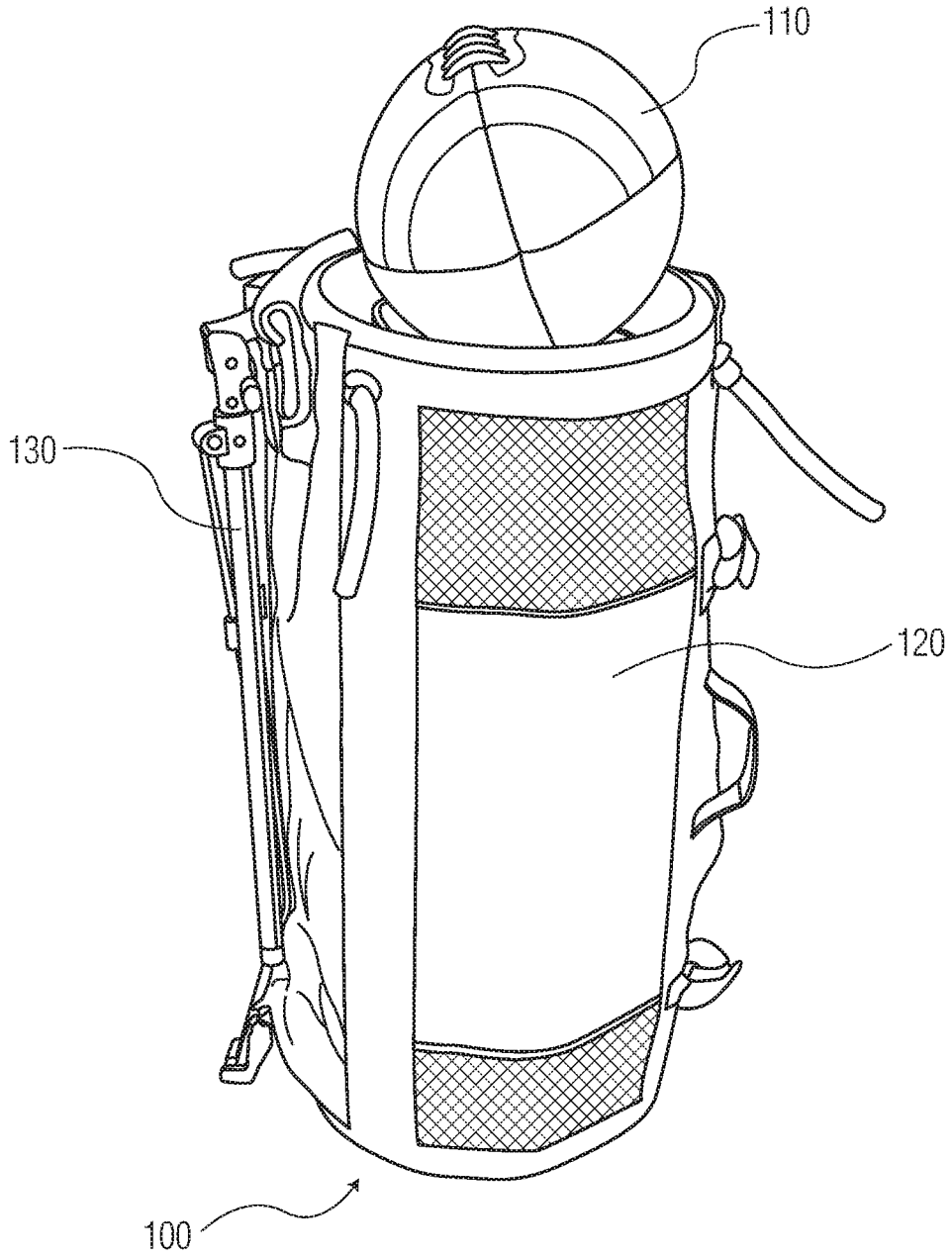
FIG. 1 shows a football snapping caddy in upright position with a football resting on top.

Referring to FIG. 1, a football snapping caddy 100 is sized to support a football 110 at a height simulating an under-center snap for a quarterback. A preferred height, when stood on an end, is 20 inches, although within reasonable variation the height may fall within 14 and 36 inches. Football snapping caddy 100 includes external covering 120, which may be nylon or other fabric, and support legs 130, which may be folded against football snapping caddy 100 when stood on end for under-center snapping and when used for storage or carrying.

Figure 2:
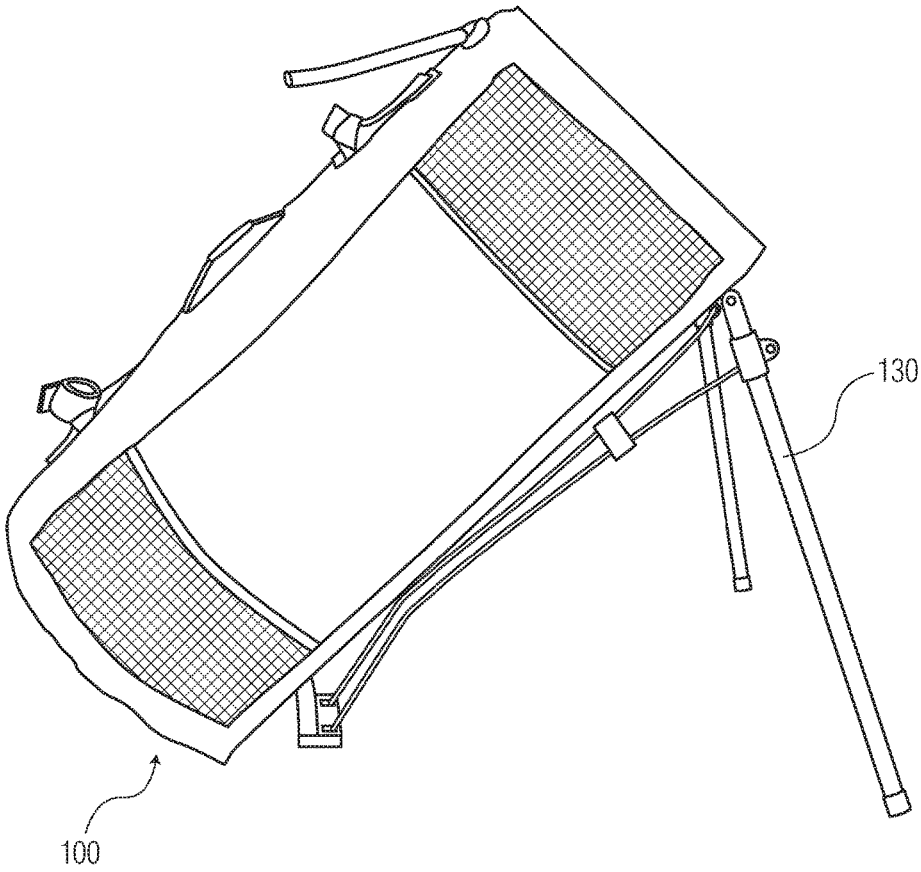
FIG. 2 shows the football snapping caddy of FIG. 1 in shotgun launch position with support legs extended.

Referring also to FIG. 2, support legs 130 may extend into a support position for using football snapping caddy 100 for shotgun snaps. Support legs 130 are preferably 16 inches long, but may vary relative to the height of football snapping caddy 100, and form an approximately 70 degree angle with football snapping caddy 100 when extended into the shotgun support position. Support legs 130 may be metal, and use spring, screw, clamp, or other standard extension control mechanism to control position from adjacent to football snapping caddy 100, out to the approximately 70 degree angle in shotgun snap positioning, and back.

Figure 3:
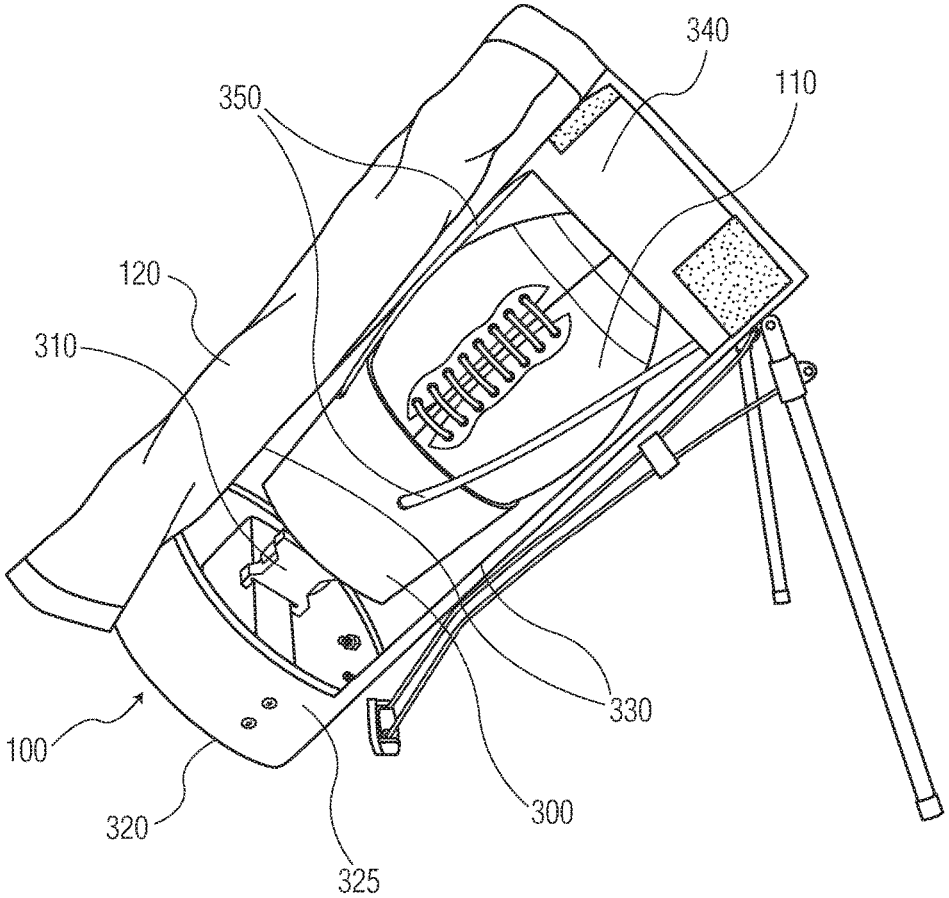
FIG. 3 shows the football snapping caddy of FIG. 2 with cover pealed back revealing the football inside in snapping launch position.
Figure 4:
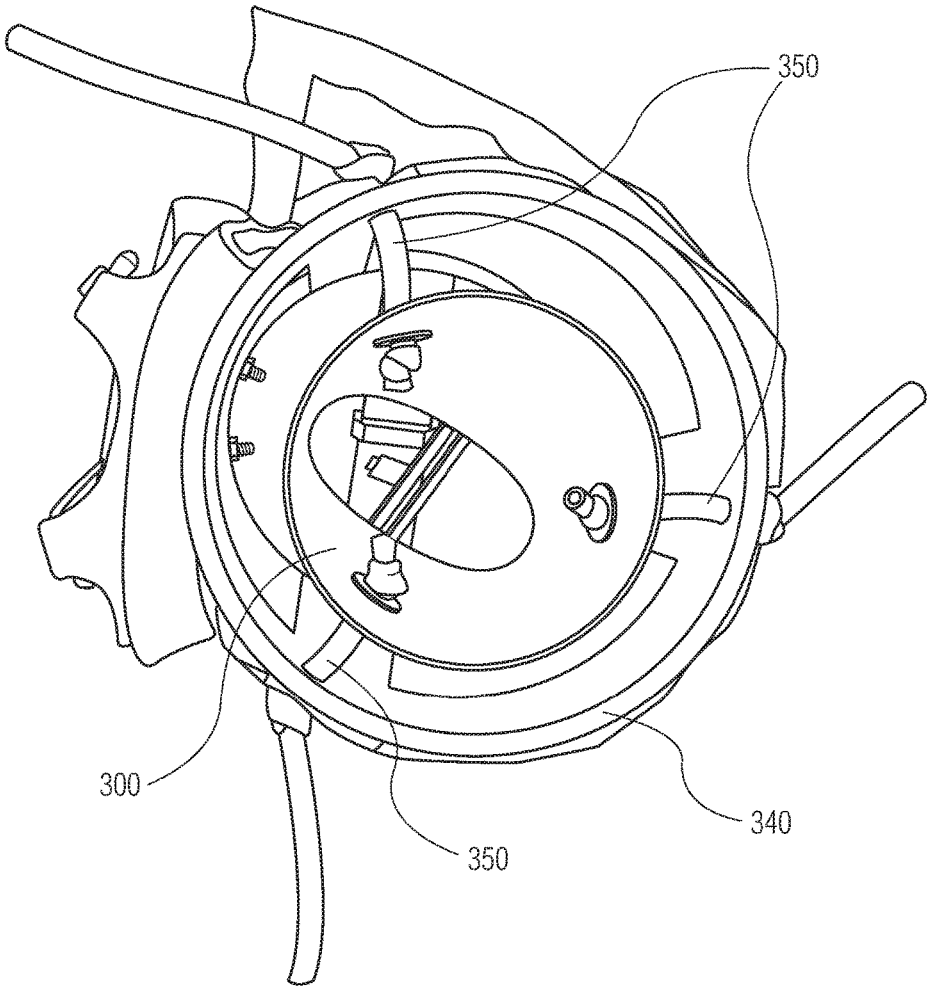
FIG. 4 shows a top-down view of the football snapping caddy of FIG. 1 without a football.

Referring also to FIG. 3, covering 120 may be rolled back to reveal or access the interior of football snapping caddy 100. When deployed to launch football snaps, football 110 may be inserted into launch cup 300 through the top of football snapping caddy 100, and pressed down to engage snap release mechanism 310. Release mechanism 310 may attach to bottom ring 320, preferably through cross-bar 325, and bottom ring 320 connects to vertical sidewalls 330, which are connected to top ring 340. Tension bands 350 connect from top ring 340 to launch cup 300. The sidewalls and top and bottom ring may be made of PVC, or similarly strong but lightweight plastic or metal. Top ring 340 is preferably sized to have an 8 inch diameter, sufficient for a football (having approximately a 7 inch diameter in the thick middle portion) to pass through. Bottom ring 320 may be similarly sized or smaller. Sidewalls 330 may be solid except for a single opening, or made of three or more connecting pieces such that a tube between the top and bottom rings is created when covering 120 is closed. At least one opening in sidewalls 330 should be greater than 7 inches wide, and extend fully between the top and bottom rings, to allow access to insert a football for storage. Optional additional openings in sidewalls 330 are preferably 5 inches wide, and should be less than 7 inches wide, to prevent a stored football from fall out. Tension bands 350 are preferably latex bands within 2.5-4 inches in length from top ring 340 to launch cup 300 when no football is present and release mechanism 310 is not engaged (as shown in FIG. 4), but may vary in length in proportion with the height of football snapping caddy 100. Preferably, three tension bands 350 are used, positioned equally around launch cup 300, but more bands may be used. Launch cup 300 may have a 5-6 inch diameter at top, with sides angled and 3-5 inches long. This diameter and size allows holding sufficient amount of football 110 within the cup to launch a spiral on release. Release mechanism 310 may be a clip-and-release, triggered manually, based on a mechanical timer, or remotely via electronic or sound-responsive control. Manual release may be extended from the snap caddy by using a connected foot pedal, which may also be stored within the caddy when not in use. For electronic control, a motor or actuator may be connected to trigger release and connected to a control unit, which may include a processor and receptor for sound detection, or for remote communication via radio, bluetooth, or other wireless signal. With remote operation, a dedicated remote control may be used in communication with the processor, or an app on a hand-held device, such as a smartphone, enabling voice commands or response to other sounds such as a hand clap.

Figure 5:
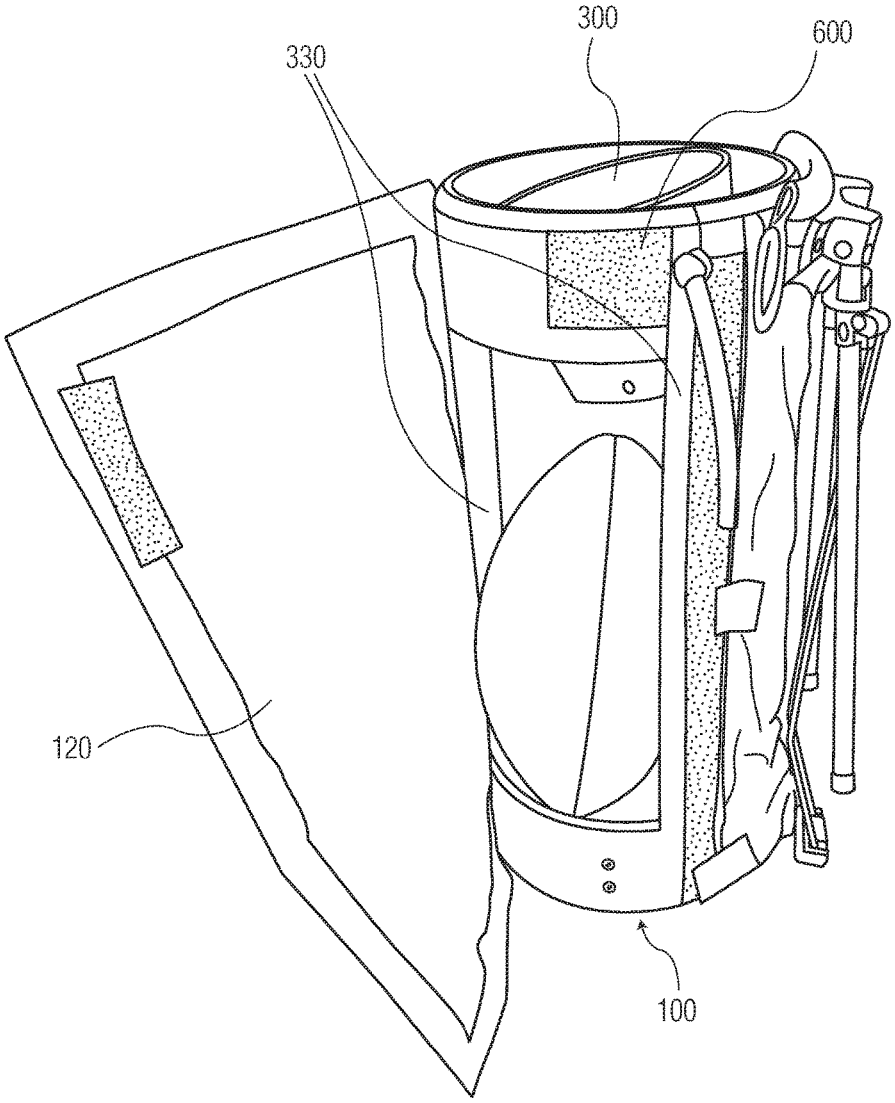
FIG. 5 shows the football snapping caddy of FIG. 1 with cover pealed back and football inserted within for storage.

Referring also to FIG. 5, when launch cup 300 is disengaged from the release mechanism, football snapping caddy 100 may also be used for football storage. Covering 120 may be opened or peeled back, such as from velcro or other connection 500, exposing the large opening between sidewalls 330. A football may be placed within football snapper caddy 100, prevented from falling out of the bottom by crossbar 325 and from falling out of the top by launch cup 300. Closing and securing covering 120 prevents football 100 from falling out of the side of football snapping caddy 100.

Figure 6:
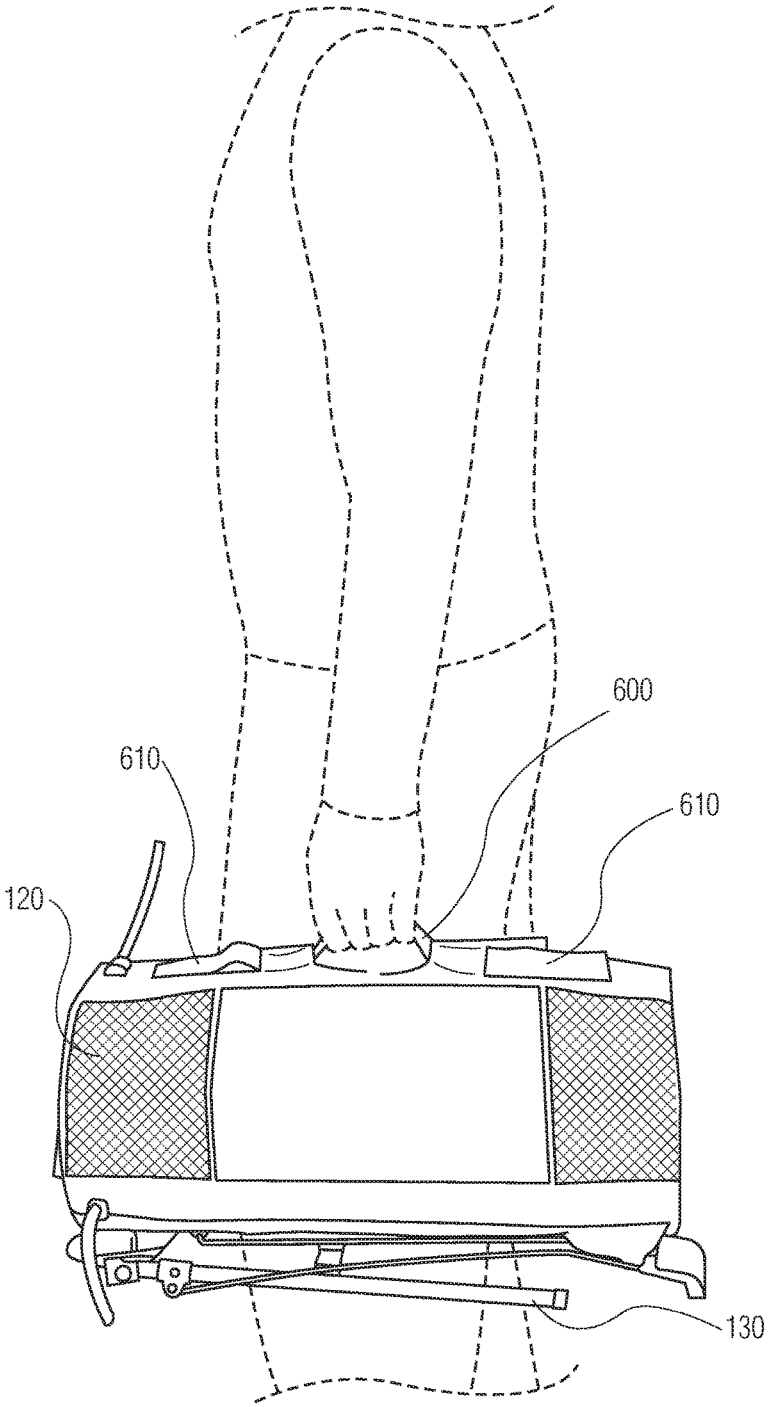
FIG. 6 shows the football snapping caddy of FIG. 1 in side-orientation for carrying.
Figure 7:
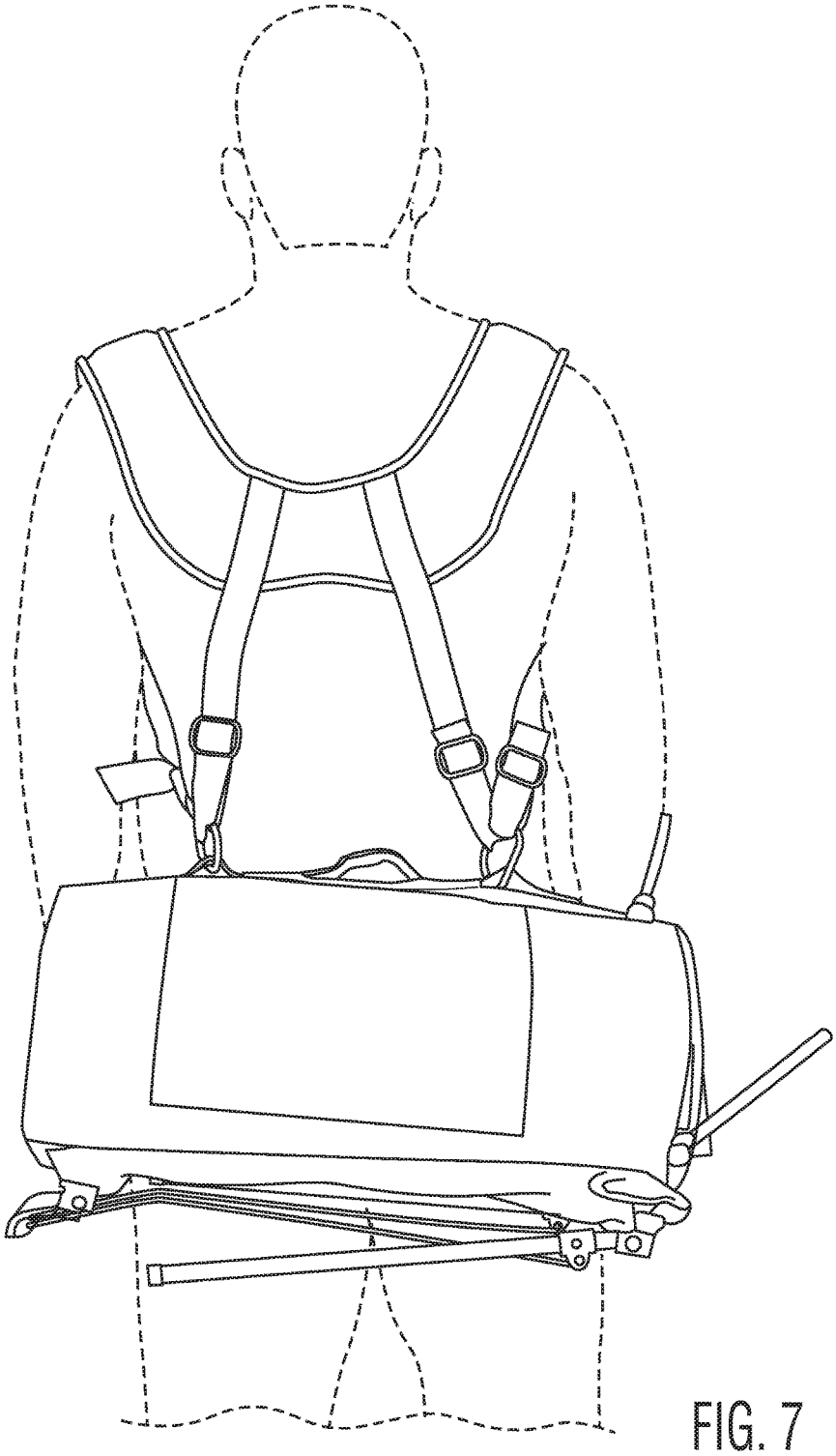
FIG. 7 shows the football snapping caddy of FIG. 6 connected to a shoulder strap.
Figure 8:
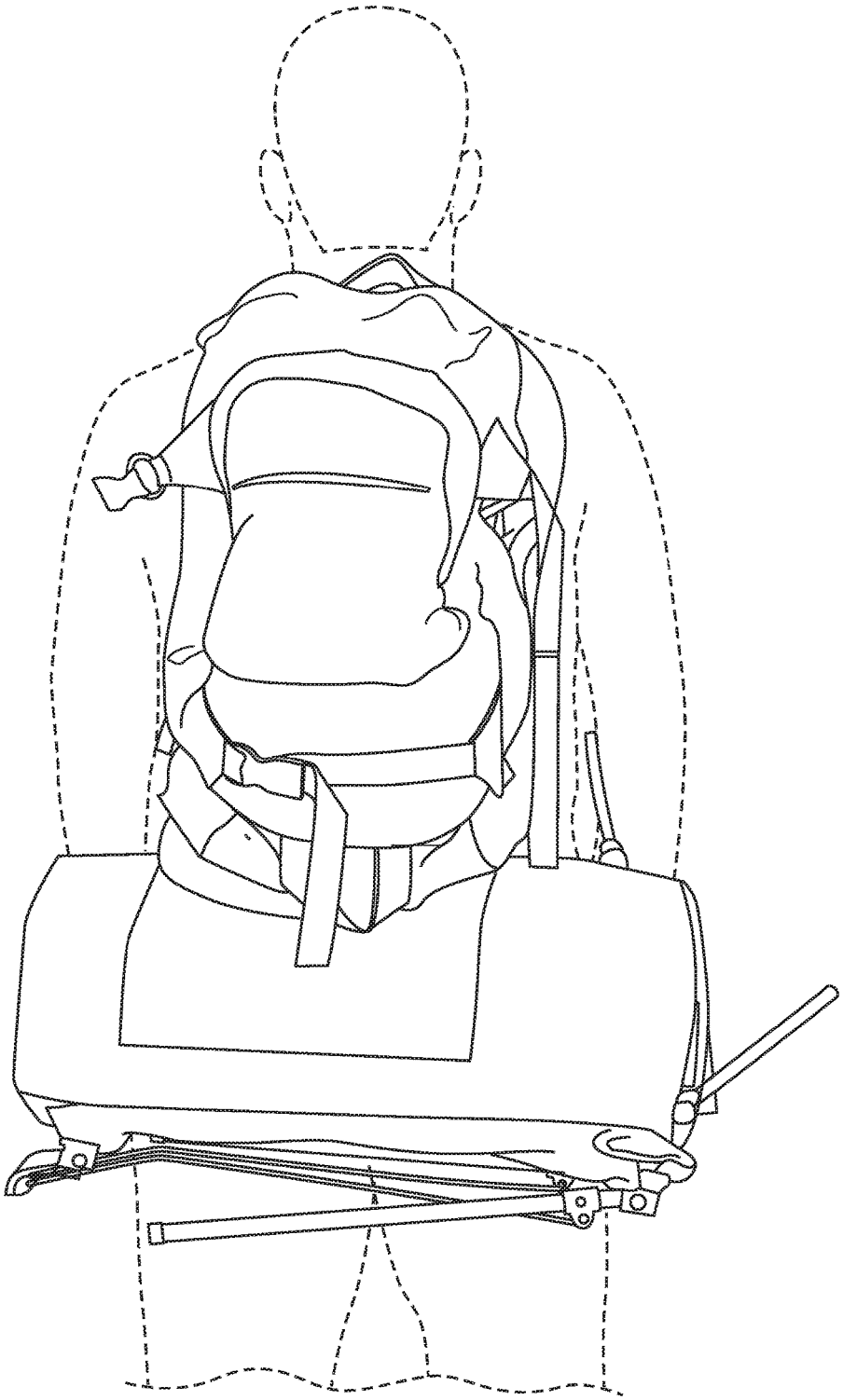
FIG. 8 shows the football snapping caddy of FIG. 6 connected to a backpack.

Referring also to FIG. 6, the center of covering 120 on the side opposite support legs 130 may include carry handle 600 and connecting clips 610. Carry handle 600 may be a flat nylon or other fabric strip, and clips 610 may be velcro or other fabric straps, metal or plastic loops, or pinch-to-open clips such as bent-gate carabiners. The handle and clips may connect to covering 120, or connect to one of sidewalls 330 through openings in covering 120. Handle 600 allows for hand carrying football snapping caddy 100, while clips 610 allow for connection to a shoulder strap as shown in FIG. 7 or to the bottom of a standard backpack as shown in FIG. 8 for simple one-person portability.

Use of the football snapping caddy consists of different stages, including storage, transport, under-center simulation, and shotgun simulation.

Storage involves opening the covering, inserting a football beneath the launch cup, and closing the covering to keep the football securely stored within. The football snapping caddy may then stand vertically with support legs collapsed to minimize space, or angled with support legs extended.

Transport involves carrying the football snapping caddy by handle, attaching a shoulder strap to clips and shoulder-carrying, or connecting the clips to the bottom sides of a backpack for carrying below a backpack. All modes, along with the football snapping caddy's size and light weight, allow single person carrying of the football snapping caddy, including a football if stored within, easily too or from any field or desired use location.

For operational use in simulating football snaps, any football if stored within is removed from the football snapping caddy. For simulating under-center snaps without a center or other person assisting a quarterback, the football snapping caddy is stood vertically, with support legs collapsed, and a football placed on top. The quarterback may then perform any desired pre-snap practice, and simulate the snap by taking the football from rest on the football snapping caddy.

For simulating shotgun snaps without a center or other person assisting a quarterback, the football snapping caddy is angled with support legs extended, pointing the top in the direction of the quarterback. A football is inserted in to the launch cup through the top ring, and pushed down until the release mechanism engages. The quarterback may then move to shotgun positioning, and receive a shotgun snap upon release. Release may be triggered manually, including by stepping on a pedal connected to the release mechanism, automatically by mechanical timer connected to the release mechanism, or triggered remotely by electronic or sound activation under control of the quarterback.

In this fashion, a quarterback may store and transport a football along with personal center for individual practice or multi-person practice where no individual is needed to fill the role of center/football snapper.

The covering may include additional pockets or space to store and carry other football-practice related items, such as a water bottle, playbook, or training camera such as a GoPro.

It is to be understood that the above description is intended to be illustrative, and not restrictive. Many other embodiments will be apparent to those of skill in the art upon reviewing the above description. The scope should, therefore, be determined with reference to the appended claims, along with the full scope of equivalents to which such claims are entitled.

What is claimed is:

1. A football snapping caddy comprising:

a circular top ring with diameter larger than a diameter of a football;

three or more vertical sidewalls connected to the top ring, spaced such that an opening between two of the vertical sidewalls is larger than a diameter of the football;

a circular bottom ring connected to the three or more vertical sidewalls;

a cross bar connected to the circular bottom ring;

a release mechanism connected to the cross bar;

three or more tension bands connected to the top ring;

a launch cup connected to the three or more tension bands, positioned such that when pressed down the launch cup reaches and engages the release mechanism;

a covering around the three or more vertical sidewalls; and two or more support legs collapsible against the covering and extendible to position the football snapping caddy to launch a shotgun snap of the football.

2. The snapping caddy of claim 1, wherein the support legs are approximately sixteen inches long.

3. The snapping caddy of claim 1, wherein the support legs in extended position form an approximately 70 degree angle with the football caddy.

4. The snapping caddy of claim 1, wherein the covering is partially detachable such that the covering rolls back around the caddy, exposing an opening between two of the vertical sidewalls with room to insert the football for storage between the cross bar and the launch cup when not engaged with the release mechanism.

5. The snapping caddy of claim 1, wherein the snapping caddy has a height of approximately 20 inches measured when stood vertically on the bottom ring.

6. The snapping caddy of claim 1, wherein the tension bands are latex bands with approximately two and a half to four inches of length from the top ring connection to the launch cup connection when the launch cup is not engaged with the release mechanism.

7. The snapping caddy of claim 1, wherein the launch cup has an approximately five to six inch diameter on a top side, and angled sides approximately three to five inches long.

8. The snapping caddy of claim 1, wherein the release mechanism is a clip and release.

9. The snapping caddy of claim 8, further comprising a mechanical timer connected to release the clip after engaging the launch cup.

10. The snapping caddy of claim 8, further comprising a foot pedal connected to release the clip after engaging the launch cup.

11. The snapping caddy of claim 8, further comprising an electric motor or actuator to release the clip after engaging the launch cup.

12. The snapping caddy of claim 11, further comprising a communication processor connected to the electric motor or actuator, the communication processor controlling the electric motor or actuator for release upon receipt of a radio, bluetooth, or other wireless signal.

13. The snapping caddy of claim 1, further comprising a carry handle connected to a side opposite from the support legs.

14. The snapping caddy of claim 13, further comprising two or more connecting clips on the side opposite from the support legs.

15. The snapping caddy of claim 14, further comprising a shoulder strap connected to the connecting clips.

16. The snapping caddy of claim 14, further comprising a backpack connected to the connecting clips.

17. The snapping caddy of claim 14, wherein the carry handle and the connecting clips are connected to the covering.

18. The snapping caddy of claim 14, wherein the carry handle and the connecting clips are connected to one of the vertical sidewalls through gaps in the covering.

* * * * *